US006808174B1

(12) United States Patent
Rubin

(10) Patent No.: US 6,808,174 B1
(45) Date of Patent: Oct. 26, 2004

(54) CARD GAME

(75) Inventor: Hal Rubin, Pound Ridge, NY (US)

(73) Assignee: Full House Gaming Inc., Pound Ridge, NY (US)

( * ) Notice: Subject to any disclaimer, the term of this patent is extended or adjusted under 35 U.S.C. 154(b) by 0 days.

(21) Appl. No.: 10/662,894

(22) Filed: Sep. 15, 2003

(51) Int. Cl.[7] ..... A63F 1/00
(52) U.S. Cl. ..... 273/292; 273/274; 463/12
(58) Field of Search ..... 273/292, 274, 273/309; 463/12, 13

(56) References Cited

U.S. PATENT DOCUMENTS 5,607,162 A * 3/1997 Boylan et al. ..... 273/292
6,536,769 B1 * 3/2003 Palacios et al. ..... 273/292
6,581,936 B1 * 6/2003 Zoccolillo et al. ..... 273/274
6,637,746 B1 * 10/2003 Baranauskas ..... 273/292
6,637,748 B1 * 10/2003 Yuan ..... 273/292

* cited by examiner

*Primary Examiner*—Benjamin Layno
(74) *Attorney, Agent, or Firm*—Joseph P. Quinn; Brown Rudnick Berlack Israels LLP

(57) ABSTRACT

A card game combining chance and skill. Cards having a rank of two through ten represent corresponding point values. Face cards each represent a point value of ten. Aces represent one and/or eleven at the player's choice. Players must commit wagers for a specific number of HIGH/LOW bets of equal value before the deal. Players are dealt a hand, face up, and the dealer is dealt a hand face down. The dealer turns his cards one at a time. Players must discard cards which match the rank of a cards turned over by the dealer. Using their committed wagers, players make a first HIGH, LOW or split bet after the deal and another bet after the turn of each dealer card. A separate payoff for each bet is determined based on whether the players final point sum was within the predetermined high or low range as predicted by the particular bet.

24 Claims, 2 Drawing Sheets

PAYOUT TABLE

| | | PAYOUT |
|---|---|---|
| HIGH RANGE: | TOTAL POINT VALUE OF 30 - 44 POINTS | EVEN MONEY |
| LOW RANGE: | TOTAL POINT VALUE OF 0 - 20 POINTS | EVEN MONEY |
| SPLIT BET IN HIGH AND LOW RANGE | | TWO TO ONE |
| BONUS HIGH RANGE: | TOTAL POINT VALUE OF 40 - 44 POINTS | THREE TO ONE -LAST BET ONLY |
| BONUS LOW RANGE: | TOTAL POINT VALUE OF 0 - 5 POINTS | THREE TO ONE - LAST BET ONLY |
| BONUS HANDS: | FOUR CARD FLUSHES, FOUR CARD STRAIGHTS | TWO TO ONE |

FIG. 2

CARD GAME

FIELD OF THE INVENTION

The present application relates to gaming and particularly to card games for entertainment, and gambling including for casino gambling.

BACKGROUND OF THE INVENTION

Individual players and groups have historically engaged in many types of card games for entertainment and gambling. The standard deck of 52 playing cards including each of the set of ace, two–ten, jack, queen and king, in each of four suits including diamonds, clubs, hearts and spades is the basis of many known varieties of many different card games. The playing and outcome of some card games is dictated entirely by chance typically by the random selection of particular cards from a deck. But most card games provide opportunities for players having some degree of skill to increase their likelihood of winning a game against other lesser skilled players or against a dealer representing a casino, i.e., "the house." Such skill usually involves memory, quick thinking and/or knowledge of probabilities that various card combinations are held by others or by the dealer.

For many years, varieties of a few common card games such as, for example, poker and black-jack, have been most popular for entertainment, informal gambling and casino gambling. Casino gambling including gambling on card games has become an enormous industry earning hundreds of millions of dollars. Highly skilled players engage in championship tournaments which attract worldwide interest and competition.

A large percentage of casino patrons, however, are not highly skilled. Such patrons often prefer games that are easy to learn but still reward some degree of skill. Many casino patrons are intimidated by the competition or bored with traditional card games and therefore enjoy new card games that are periodically introduced at casinos. To remain competitive, casinos must continuously introduce new games which are preferably exciting, easy to learn and which reward some degree of skill.

SUMMARY OF THE INVENTION

The present invention comprises a card game combining elements of chance and skill. The game can be played with one or more standard deck of 52 playing cards. To enter the game, each player must commit to making a set of equal valued bets. A dealer distributes a plurality of cards face up to each player and a plurality of cards face down to himself. In at least one embodiment of the invention, the number of cards distributed to the dealer equals the number of cards distributed to each player. Cards having a rank of deuce through ten represent corresponding point values. Face cards, i.e. King, Queen and Jack each represent a point value of ten. Players holding an ace choose whether it represents a point value of one or eleven for any given bet.

After dealing a set of cards to each player, the dealer turns each of his cards face up, one card at a time. Players must discard the cards they are holding which have the same rank regardless of rank of a card turned over by the dealer immediately after the dealer turns over his card.

Players must try to predict whether the sum of point values associated with the cards remaining in their hand will be within a predetermined high range or a predetermined low range when the game is finished. Each player commits, i.e. places, a certain number of bets before cards are dealt. The player then adjusts, i.e. moves a first bet immediately after his hand is dealt and adjusts each subsequent bet after each additional card is turned over by the dealer. Bets are adjusted by identifying the bet as a HIGH bet or a LOW bet according to whether the player predicts that the final sum in his hand to be within the predetermined high or low range respectively. Alternatively, the player may split his bet by designating half of the bet as a HIGH bet and half of his bet as a LOW bet. When each of the dealer's cards has been turned face up, players total the point value represented by all of the cards remaining in their hand. If a player's total remaining point value is within the predetermined high range, the player collects winnings for each of the HIGH bets that he had indicated. If the player's total remaining point value is within the predetermined low range, the player collects winnings for each of the LOW bets that he had indicated. If a player holds at least one ace and his total remaining point value can be within both the HIGH and LOW ranges, then the player will collect additional winnings for each of his split bets.

Winning amounts can be equal to or multiples of the amount of the players individual bets. Various embodiments of the game include additional payout amounts when a player's hand includes particular card combinations. Further embodiments include a game which includes a bonus bet which pays additional winnings for any number of possible bonus conditions.

The present invention overcomes disadvantages of the prior art by featuring a game that is suitable for use in casinos and easy for unskilled players to learn. The game according to the various embodiments of the present invention is fun to play and rewards a level of skill that is easily attainable by most casino patrons.

BRIEF DESCRIPTION OF THE DRAWINGS

The foregoing and other features and advantages of the present invention will be more fully understood from the following detailed description of illustrative embodiments, taken in conjunction with the accompanying drawings in which:

FIG. 2 is an exemplary payout table according to an illustrative embodiment of the present invention.

DETAILED DESCRIPTION

Figure 1:
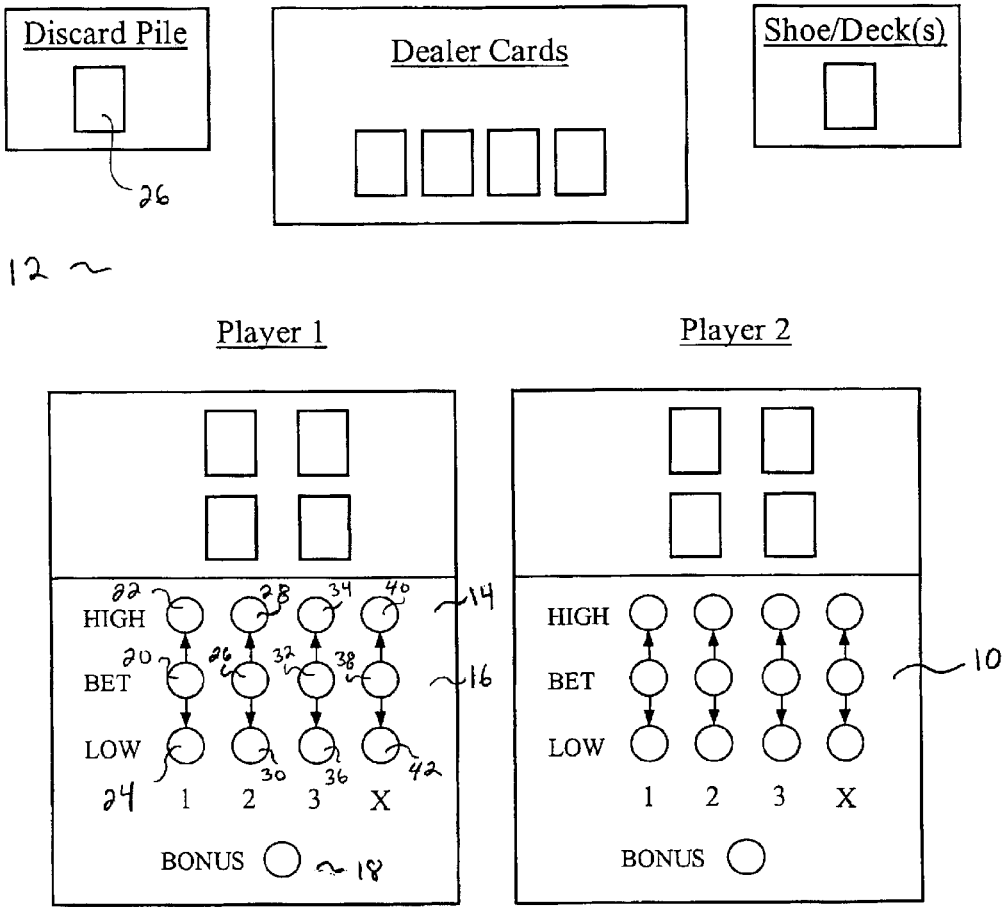
FIG. 1 is a top view of a gaming table having betting areas and card placement areas according to an illustrative embodiment of the present invention.

An illustrative embodiment of the present invention is initially described with reference to FIG. 1 which depicts an exemplary bet placement arrangement 10 and card placement arrangement 12. A set of equal valued mandatory bets must be placed by each player before the game begins. In the illustrative embodiment as many as seven players may participate in the game. Four mandatory bets from each player are required. The mandatory bets are committed by placing betting chips in the center of a bet placement array 14 as provided, for example, by the row labeled "BET" 16 for each player in FIG. 1. An optional bet can be placed by any player, for example by placing betting chips in the respective location labeled "BONUS" 18 in that player's position.

Using one or more standard 52 card decks of playing cards, a number of cards are dealt face up to each player and the same number of cards is dealt face down to a dealer. In the illustrative embodiment, the dealer waits for all players to place their mandatory bets before distributing four face-up cards to each player and four face-down cards to himself.

Once the cards are dealt, each player evaluates his hand and makes a first mandatory bet according to whether he believes the point total of his final remaining cards is more likely to be in a predetermined high range or a predetermined low range. The predetermined high range and predetermined low range is made known to each player before the game begins, for example, by a placard placed on the gaming table. In the illustrative embodiment, the predetermined high range is 30–44 points and the predetermined low range is 0–20 points. The player makes his first bet by moving the betting chips from the 'BET' location 20 in the '1' column to either the 'HIGH' location 22 or 'LOW' location 24 in the '1' column. Alternatively, the player can make a split bet by moving half of his betting chips from the 'BET' location 20 in the '1' column to the 'HIGH' location 22 in the '1' column and half of his betting chips to the 'LOW' location 24 in the '1' column.

After each player makes his first bet, the dealer turns one of the cards in his hand (i.e. the first card) face-up. Each player then discards every card in his own hand that matches the rank of the dealer card, regardless of suit. In the illustrative embodiment discarded cards are placed in the discard pile 26. Players do not discard other cards which have the same point value. For example, if the dealer turns over a Jack, the players must discard all of their Jacks, but may hold their tens, Queens and Kings.

The players must then reevaluate the probability that their final point total will be in the high or Low range and make a second bet. The second bet is made, for example, by moving the player's betting chips from the BET location 26 in the '2' column to either the HIGH location 28 or LOW location 30 in the '2' column, or splitting the bet as described hereinbefore.

After each player makes his second bet, the dealer turns over another of the cards in his hand (i.e., his second card). Each player then discards every card in his hand that matches the newly turned card regardless of suit. The players again reevaluate the probability that their final point total will be in the High or Low range and make a third bet. The third bet is made, for example, by moving the player's betting chips from the BET location 32 in the '3' column to either the High location 34 or Low location 36 in the '3' column or splitting the bet as described hereinbefore.

After each player makes his third bet, the dealer turns over another of the cards in his hand, (i.e., his third card). Each player then discards every card in his hand that matches the newly turned card regardless of suit. The players again evaluate the probability that their final point total will be in the High or Low range and make a fourth bet. The fourth bet is made, for example, by moving the player's betting chips from the BET location 38 in the 'X' column to either the High location 40 or Low location 42 in the 'X' column or splitting the bet as described hereinbefore.

After each player makes his final bet, which in the illustrative embodiment is his fourth bet, the dealer turns over his final card. Each player then discards every card in his hand that matches the newly turned card regardless of suit. The players compute their total point value of their remaining cards and compare their total point value with the predetermined High and Low range. If a player's total point value is in the High range, then the player collects winnings for each of his High bets, i.e. each of his bits in the High row. If a player's total point value is in the Low range then the player collects winnings for each of his Low bets, i.e. each of his bets in the Low row. If a player has one or more aces in his remaining hands he can choose to assign a one or an eleven to each ace for each individual bet.

Payout is determined according to a predetermined payout table. An exemplary payout table 50 that can be used to practice the present invention is illustrated in FIG. 2.

At least one illustrative embodiment of the invention provides a method of playing a card game among a plurality of Players and a Dealer. Each player wagers against the Dealer. At least one standard poker deck of 52 cards is shuffled. The standard poker deck includes four cards of each rank comprising four Aces, four Twos, four Threes, four Fours, four Fives, four Sixes, four Sevens, four Eights, four Nines, four Tens, four Jacks, four Queens and four Kings.

Each Player wagers against the Dealer and provides value for a set of equal valued bets. The set of equal valued bets includes a first bet, a second bet, a third bet and a fourth bet. A hand of cards is dealt to each Player and a face down hand of cards is dealt to the Dealer. An opportunity is provided for each Player to view his own hand of cards. Each Player identifies his first bet as a high bet, a low bet or a split bet after having the opportunity to view their cards.

The first card of the Dealer's hand of cards is revealed for each Player to view. Each player must discard each card in their hand of cards that has a rank equal to the rank of the first card of the Dealer's hand. Each Player then identifies his second bet as a high bet, a low bet or a split bet after the first card of the Dealer's hand is revealed.

The second card of the Dealer's hand of cards is then revealed for each Player to view. Each Player must then discard each card in their hand of cards that has a rank equal to the rank of the second card of the Dealer's hand. Each Player then identifies its third bet as a high bet, a low bet, or a split bet after said second card is revealed.

The third card of the Dealer's hand of cards is then revealed for each Player to view. Each Player must then discard each card in their hand of cards that has a rank equal to the rank of the third card of the Dealer's hand. Each Player identifies its fourth bet as a high bet, a low bet or a split bet after said third card is revealed.

The fourth card of the Dealer's hand of cards is revealed for each Player to view. Each Player discards each card in their hand of cards that has a rank equal to the rank of the fourth card of the Dealer's hand.

Next, a sum of point values of a Player's remaining hand of cards is computed. It is determined whether the point value of a Player's hand is within a predetermined high range and/or a predetermined low range. A payout amount for each Player is determined according to whether each of the Player's first bet, second bet, third bet and/or fourth bet identified High and/or Low in correspondence with the Predetermined High Range and/or Predetermined Low of the total point value of said Player's hand.

In at least one embodiment of the invention, two computing steps are performed for each hand including an Ace. In the first calculation, each Ace has a point value of one. In a second calculation each Ace has a value of eleven. Players holding an Ace therefore have the opportunity to have a sum of point values in both the Predetermined High Range and the Predetermined Low Range.

In at least one embodiment of the invention, each hand of cards includes four cards. In an alternative embodiment, the Dealer's hand includes five cards. In another alternative embodiment, each of said Players' hands includes five cards.

In at least one embodiment of the invention, the payout is determined by providing winnings of equal value to each correctly placed bet of said first, second, third and fourth bets. A correctly placed bet corresponds to a bet identified as High if the total point value of a corresponding Player's hand is within the Predetermined High Range and a bet identified as Low if the total point value of a corresponding Player's hand is within the Predetermined Low Range. The Predetermined High and Low ranges are defined and made known to each Player before the game according to the various embodiment of the invention is played. Ranges are defined to provide a predetermined probability of winning by any player.

In one embodiment, at least one bet can be identified as a Split bet. A bonus payout can be provided to each Player identifying a split bet who has at least one Ace in his hand. If the Player's total point value is within the Predetermined High Range when his Ace or Aces has a point value of eleven, and his total point value is within the Predetermined Low Range when his Ace or Aces has a point value of one.

In yet another embodiment of the invention, the set of equal valued bets further includes a fifth bet. Each player optionally provides value for the fifth bet. A bonus payout is provided to each player having made the fifth bet if the Dealer's hand of cards corresponds to a previously identified bonus hand. Examples of a previously identified bonus hand include a straight, flush, or any pre-identified poker hand, for example. Various odds can be provided to adjust the payout according to the probability of the outcome for each particular pre-identified poker hand.

In at least one embodiment, the Dealer's hand of cards includes a fifth card. The bonus payout can be determined according to the first, second, third and fourth cards revealed in the Dealer's hand. The point value of the fifth card in the Dealer's hand can be added to each Player's total point value.

In another embodiment, the set of equal valued bets further includes a fifth bet. Each Player optionally provides value for said fifth bet. A bonus payout can be provided to each player having made a fifth bet if said Player's hand of cards corresponds to a previously identified bonus hand before any of said Player's cards are surrendered.

In one embodiment of the invention, each of the Player's card hands is dealt face up and viewable by each Player. In another embodiment, Each of the Players' card hands are dealt face down, wherein each Player can view its own card hard hand, and can not view another Player's card hand.

In a particular embodiment of the invention, a cumulative bonus amount is paid to any player having discarded its entire hand of cards. The cumulative bonus amount can be increased if no Player discards his entire hand of cards. An increased cumulative bonus amount is applied to a next game. The next game can includes a game at any number of tables or locations.

In another alternative embodiment of the invention, a Dealer's second hand of cards is dealt to the dealer. Each Player predicts whether a sum of point values for their own remaining hand of cards will be greater than or less than a sum of point values in the Dealer's remaining hand of cards from the Dealer's second hand of cards. The Dealer's second hand of card can be played like a Player's hand wherein each card having a rank equal to the rank of the first card, second card and third card overturned in the Dealer's first hand must be discarded. A sum of point values of the Dealer's remaining hand of cards from said Dealer's second hand of cards is computed after the discarding steps have occurred. A payout is paid to a Player only if the Player's prediction regarding the Dealer's second hand holds true.

In at least one embodiment, each Player is provided with an opportunity to withdraw from the game after viewing his hand of cards and before said first card is revealed. Each Player who withdraws from said game is retrieves a portion, for example, half, of their wager.

In another embodiment, the invention provides a card game among a plurality of Players and a Dealer wherein each player wagers against the Dealer. At least one deck of cards is shuffled. The deck of cards can be a standard poker deck or may be include more or fewer cards than a standard poker deck. For example, additional cards such as one or more Joker cards may be included in the deck. Each Joker can be assigned a point value and played like any other card, or may provide an opportunity for a player holding a Joker to win a bonus, for example. In another example, all cards having a point value of 10 are removed from the deck. Each Player wagers against the Dealer wherein each player provides value for a set of bets.

A hand of cards is dealt to each Player and a face down hand of cards is dealt to the Dealer. An opportunity is provided for each Player to view his own hand of cards. Each Player identifies each of its bets as a high bet, a low bet or a split bet after having an opportunity to view their cards.

The Dealer's hand of cards is revealed for each Player to view. Each Player discards each card in their hand of cards that has a rank equal to the rank of revealed cards in said Dealer's hand of cards.

A sum of point values of a Player's remaining hand of cards is computed. It is then determined whether the point value of a Player's hand is within a predetermined high range and/or a predetermined low range. A payout amount is determined for each Player according to whether each of the Player's bets identified High and/or Low in correspondence with the Predetermined High Range and/or Predetermined Low of the sum of point values of the Player's remaining hand of cards.

In at least one embodiment Players do not have an opportunity to change bets after any of the Dealer's cards are revealed. In an alternative embodiment, each player has at least one opportunity to change bets after some but not all of said Dealer's cards are revealed.

In still another embodiment, the game according to the present invention is played electronically using an electronic representation of at least one standard poker deck of 52 playing cards.

Although the present invention is described generally herein as being played with four cards dealt to each player and to the dealer, persons skilled in the art should appreciate that the invention may also be practiced by dealing more or fewer cards to each player and the dealer without departing from the spirit and scope of the invention. It should be appreciated that embodiments which deal more or fewer cards to each player also will require more or fewer corresponding mandatory bets.

Although the present invention is described generally in terms of a standard 52 card deck, persons skilled in the art should understand that the present invention can be practiced with a variety of different card types or sets of symbolic objects, such as chips, coupons, tickets, or tokens in place of cards.

What is claimed is:

1. A method of playing a card game among a plurality of Players and a Dealer wherein each player wagers against the Dealer, the method comprising the steps of:

shuffling at least one standard poker deck of 52 cards comprising four Aces, four Twos, four Threes, four Fours, four Fives, four Sixes, four Sevens, four Eights, four Nines, four Tens, four Jacks, four Queens and four Kings;

wagering by each Player against the Dealer wherein each player provides value for a set of equal valued bets comprising a first bet, a second bet, a third bet and a fourth bet;

dealing a hand of cards to each Player and a face down hand of cards to the Dealer;

providing an opportunity for each Player to view his own hand of cards;

each Player identifying its first bet as a high bet, a low bet or a split bet after having said opportunity;

revealing a first card of the Dealer's hand of cards for each Player to view;

each Player discarding each card in their hand of cards that has a rank equal to the rank of said first card;

each Player identifying its second bet as a high bet, a low bet or a split bet after said first card is revealed;

revealing a second card of the Dealer's hand of cards for each Player to view;

each Player discarding each card in their hand of cards that has a rank equal to the rank of said second card;

each Player identifying its third bet as a high bet, a low bet, or a split bet after said second card is revealed;

revealing a third card of the Dealer's hand of cards for each Player to view;

each Player discarding each card in their hand of cards that has a rank equal to the rank of said third card;

each Player identifying its fourth bet as a high bet, a low bet or a split bet after said third card is revealed;

revealing a fourth card of the Dealer's hand of cards for each Player to view;

each Player discarding each card in their hand of cards that has a rank equal to the rank of said fourth card;

computing a sum of point values of a Player's remaining hand of cards, determining whether the point value of a Player's hand is within a predetermined high range and/or a predetermined low range;

determining a payout amount for each Player according to whether each of said Player's first bet, second bet, third bet and/or fourth bet identified High and/or Low in correspondence with the Predetermined High Range and/or Predetermined Low of the total point value of said Player's hand.

2. The method according to claim 1, wherein each Two has a point value of two points;

wherein each Three has a point value of three points;

wherein each Four has a point value of four points;

wherein each Five has a point value of five points;

wherein each Six has a point value of six points;

wherein each Seven has a point value of seven points;

wherein each Eight has a point value of eight points;

wherein each Nine has a point value of nine points;

wherein each Ten, Jack, Queen and King has a point value of ten points]; and wherein two computing steps are performed for each hand including an Ace, wherein in a first computing step each Ace has a point value of one, and in a second computing step each Ace has a value of eleven.

3. The method according to claim 2 wherein said payout is determined by providing winnings of equal value to each correctly placed bet of said first, second, third and fourth bets; and wherein a correctly placed bet corresponds to a bet identified as High if the total point value of a corresponding Player's hand is within said Predetermined High Range and a bet identified as Low if the total point value of a corresponding Player's hand is within said Predetermined Low Range.

4. The method according to claim 3 further comprising the steps of identifying a bet as a Split Bet; and providing a bonus payout to each Player identifying a split bet having at least one Ace in said Player's hand, if said total point value is within said Predetermined High Range when said at least one Ace has a point value of eleven, and said total point value is within said Predetermined Low Range when said at least one Ace has a point value of one.

5. The method according to claim 1 wherein each hand of cards includes four cards.

6. The method according to claim 1 wherein said Dealer's hand includes five cards.

7. The method according to claim 6 wherein each of said Players' hands includes five cards.

8. The method according to claim 1 wherein said set of equal valued bets further comprises a fifth bet;

each player optionally providing value for said fifth bet; and providing a bonus payout to each player having made said fifth bet if said Dealer's hand of cards corresponds to a previously identified bonus hand.

9. The method according to claim 8 wherein said Dealer's hand of cards includes a fifth card.

10. The method according to claim 9 further comprising:

determining said bonus payout according to said first, second third and fourth cards; and adding the point value of said fifth card to each of said Player's total point value.

11. The method according to claim 1 wherein said set of equal valued bets further comprises a fifth bet;

each Player optionally providing value for said fifth bet; and providing a bonus payout to each player having made said fifth bet if said Player's hand of cards corresponds to a previously identified bonus hand before any of said Player's cards are surrendered.

12. The method according to claim 1 wherein each of said Player's card hands are dealt face up and viewable by each Player.

13. The method according to claim 1 wherein each of said Players' card hands are dealt face down, wherein each Player can view its own card hard hand, and can not view another Player's card hand.

14. The method according to claim 1 further comprising:

paying a cumulative bonus amount to any player having discarded its entire hand of cards.

15. The method according to claim 14 wherein said cumulative bonus amount is increased if no Player discards his entire hand of cards; and wherein an increased cumulative bonus amount is applied to a next game.

16. The method according to claim 15 wherein said next game includes a game at any number of locations.

17. The method according to claim 1 further comprising:

dealing a Dealer's second hand of cards to said dealer;

each Player predicting whether a sum of point values for their own remaining hand of cards will be greater than or less than a sum of point values in said Dealer's remaining hand of cards from said Dealer's second hand of cards;

discarding each card in said Dealer's second hand of cards having a rank equal to the rank of said first card, said second card and said third card;

computing said a sum of point values of said Dealer's remaining hand of cards from said Dealer's second hand of cards after said discarding step;

awarding said payout to a Player only if said Player's prediction holds true.

18. The method according to claim 1 wherein each Player is provided with an opportunity to withdraw from said game after viewing his hand of cards and before said first card is revealed;

wherein each Player who withdraws from said game is retrieves half of their wager.

19. A method of playing a card game among a plurality of Players and a Dealer wherein each player wagers against the Dealer, the method comprising the steps of:

shuffling at least one deck of cards;

wagering by each Player against the Dealer wherein each player provides value for a set of bets;

dealing a hand of cards to each Player and a face down hand of cards to the Dealer;

providing an opportunity for each Player to view his own hand of cards;

each Player identifying each of its bets as a high bet, a low bet or a split bet after having said opportunity;

revealing cards of the Dealer's hand of cards for each Player to view;

each Player discarding each card in their hand of cards that has a rank equal to the rank of revealed cards in said Dealer's hand of cards;

computing a sum of point values of a Player's remaining hand of cards, determining whether the point value of a Player's hand is within a predetermined high range and/or a predetermined low range;

determining a payout amount for each Player according to whether each of said Player's bets identified High and/or Low in correspondence with the Predetermined High Range and/or Predetermined Low of the sum of point values of said Player's remaining hand of cards.

20. The method according to claim 19 wherein each Player has no opportunity to change bets after said Dealer's cards are revealed.

21. The method according to claim 19 wherein each player has at least one opportunity to change bets after some but not all of said Dealer's cards are revealed.

22. The method according to claim 19 wherein said game is played electronically using an electronic representation of at least one standard poker deck of 52 playing cards.

23. The method according to claim 19 wherein said deck of cards includes Joker cards.

24. The method according to claim 19 wherein said deck of cards includes a standard poker deck of playing cards minus at least one ranks of cards.

* * * * *